US007239303B2

(12) United States Patent
Liao et al.

(10) Patent No.: US 7,239,303 B2
(45) Date of Patent: Jul. 3, 2007

(54) KEYBOARD STRUCTURE

(75) Inventors: Pin-Chien Liao, Taoyuan (TW); Chien-Shih Hsu, Taipei (TW)

(73) Assignee: Darfon Electronics Corp., Taoyuan (TW)

( * ) Notice: Subject to any disclaimer, the term of this patent is extended or adjusted under 35 U.S.C. 154(b) by 596 days.

(21) Appl. No.: 10/786,341

(22) Filed: Feb. 25, 2004

(65) Prior Publication Data

US 2004/0174339 A1 Sep. 9, 2004

(30) Foreign Application Priority Data

Mar. 4, 2003 (TW) ..... 92104560 A

(51) Int. Cl.
*G09G 5/00* (2006.01)

(52) U.S. Cl. ..... 345/168; 200/5

(58) Field of Classification Search ..... 200/5, 200/310–317, 517, 341–345, 302.2; 362/558, 362/560, 85; 345/156–176; 341/22; 400/472
See application file for complete search history.

(56) References Cited

U.S. PATENT DOCUMENTS 6,743,993 B1 * 6/2004 Clark et al. ..... 200/314
2003/0103359 A1 * 6/2003 Chiang et al. ..... 362/558

* cited by examiner

*Primary Examiner*—Nitin I. Patel
(74) *Attorney, Agent, or Firm*—Quintero Law Office

(57) ABSTRACT

A keyboard structure. The keyboard structure includes a base plate, a light guide member, a membrane circuit board, a key assembly and a light-emitting element. The light guide member is disposed on the base plate. The membrane circuit board is disposed on the light guide member. The key assembly is disposed on the membrane circuit board, with a key cap and a resilient element between the key cap and the membrane circuit board. The light-emitting element is adjacent to the light guide member and is disposed under the membrane circuit board. Light from the light-emitting element enters the resilient element and key cap via the light guide member.

13 Claims, 4 Drawing Sheets

KEYBOARD STRUCTURE

BACKGROUND OF THE INVENTION

1. Field of the Invention

The present invention relates to a keyboard structure, and in particular to a keyboard structure that provides uniform illumination of the keys thereof.

2. Description of the Related Art

Generally, illuminated keyboards or keypads have been deployed in portable computers or cellular phones to enhance versatility thereof.

Referring to FIG. 1, a conventional illuminated keyboard structure 2 includes a base plate 21, a membrane circuit board 22, a resilient element 23, a key cap 24, a light source 25 and a light guide plate 26. The light guide plate 26 is disposed on the base plate 21 and membrane circuit board 22. The light source 25 is disposed between the membrane circuit board 22 and the light guide plate 26. Light from the light source 25 enters the key cap 24 via the light guide plate 26, illuminating the key cap 24.

Nevertheless, as shown in FIG. 1, the light guide plate 26 has a complex shape, such that manufacture thereof is difficult. Additionally, uniform illumination of the central area of the key cap 24 is difficult to achieve due to the structure of the light guide plate 26.

Hence, there is a need to provide an improved keyboard structure. The present keyboard structure is simplified and provides uniform illumination.

SUMMARY OF THE INVENTION

Accordingly, an object of the invention is to provide a keyboard structure to overcome the aforementioned problems. The keyboard structure comprises a base plate, a light guide member, a membrane circuit board, a key assembly and a light-emitting element. The light guide member is disposed on the base plate. The membrane circuit board is disposed on the light guide member. The key assembly is disposed on the membrane circuit board, with a key cap and a resilient element between the key cap and the membrane circuit board. The light-emitting element is adjacent to the light guide member and is disposed under the membrane circuit board. Light from the light-emitting element enters the resilient element and key cap via the light guide member.

The resilient element and/or membrane circuit board is transparent.

The membrane circuit board further comprises at least one through hole corresponding to the key cap. The light in the light guide member enters the key cap via the through hole.

The light guide member further comprises at least one reflective layer formed on the surface thereof to reflect the light therein.

The reflective layer is coated on or attached to the surface of the light guide member.

The light guide member further comprises a recess to receive the light-emitting element.

The key assembly further comprises a scissors connection mechanism disposed between the key cap and the membrane circuit board.

The light-emitting element is a light-emitting diode (LED).

The membrane circuit board provides power to the light-emitting element.

The light-emitting element is attached to the membrane circuit board to acquire power.

The keyboard structure further comprises a circuit board disposed under the base plate to provide power to the light-emitting element.

The light-emitting element is attached to the circuit board to acquire power.

The keyboard structure is deployed in a computer, a cellular phone, or a PDA.

A detailed description is given in the following embodiments with reference to the accompanying drawings.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

FIRST EMBODIMENT

The present invention illustrates the keyboard structure having a scissors connection mechanism for simplification of the description. The keyboard is structure of the invention may also be deployed in a cellular phone or a PDA.

Figure 1:
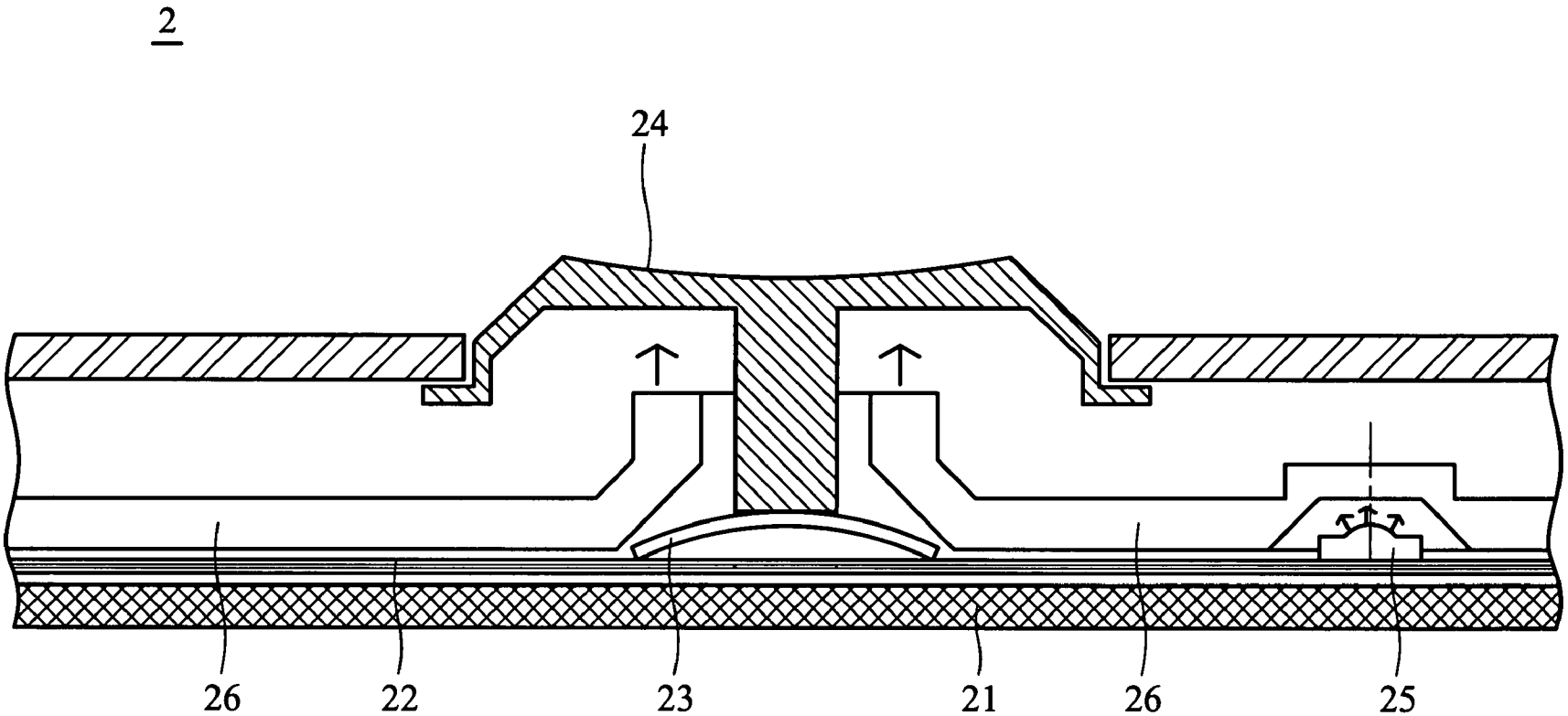
FIG. 1 ( RELATED ART )
FIG. 1 is a schematic partial cross section of a conventional illuminated keyboard structure.
Figure 2:
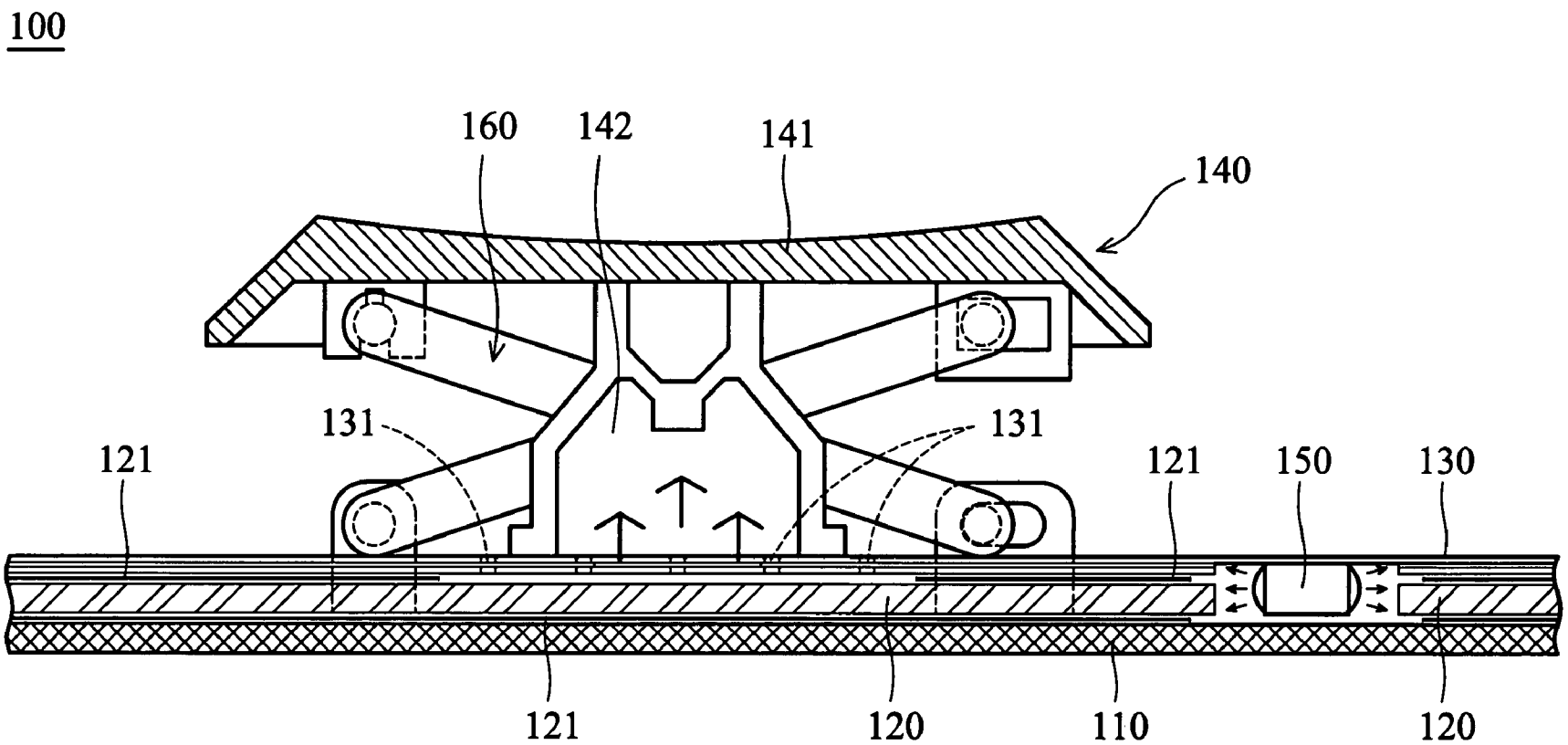
FIG. 2 is a schematic partial cross section of the keyboard structure of the first embodiment of the invention.

Referring to FIG. 2, the keyboard structure 100 comprises a base plate 110, a light guide member 120, a membrane circuit board 130, a key assembly 140 and a light-emitting element 150. The light guide member 120 is disposed on the base plate 110. The membrane circuit board 130 is disposed on the light guide member 120. The key assembly 140 is disposed on the membrane circuit board 130 and has a key cap 141 and a transparent resilient element 142 between the key cap 141 and the membrane circuit board 130. The light-emitting element 150 is disposed on one side of the light guide member 120 and under the membrane circuit board 130. Thus, the light-emitting element 150 outputs light into the light guide member 120 and the light enters the transparent resilient element 142 and key cap 141 via the light guide member 120.

As shown in FIG. 2, the membrane circuit board 130 may be transparent. A plurality of reflective layers 121 are coated on or attached to the surfaces of the light guide member 120 to reflect the light therein. Specifically, none of the reflective layers 121 is disposed on the portion with which the light guide member 120 corresponds to the transparent resilient element 142 and key cap 141. Accordingly, the light from the light-emitting element 150 can completely enter the transparent resilient element 142 and key cap 141, and the key cap 141 can be uniformly illuminated.

Specifically, even though the resilient element 142 is not transparent, the light in the light guide member 120 may still be projected upward entering the key cap 141 via the area surrounding the resilient element 142, maintaining uniform illumination of the key cap 141.

Specifically, the membrane circuit board 130 need not be transparent. As shown in FIG. 2, a plurality of through holes 131 are formed on the membrane circuit board 130 and correspond to the key cap 141. The light in the light guide member 120 can enter the resilient element 142 and key cap 141 via the through holes 131.

Additionally, the light-emitting element 150 of this embodiment may be a light-emitting diode (LED). The light-emitting element 150 is electrically connected to the membrane circuit board 130 such that the membrane circuit board 130 can provide power thereto. In this embodiment, the light-emitting element 150 is attached to the membrane circuit board 130 to acquire power therefrom.

Moreover, the keyboard structure 100 comprises a scissors connection mechanism 160 disposed between the key cap 141 and the membrane circuit board 130.

SECOND EMBODIMENT

Elements corresponding to those in the first embodiment are given the same reference numerals.

Figure 3:
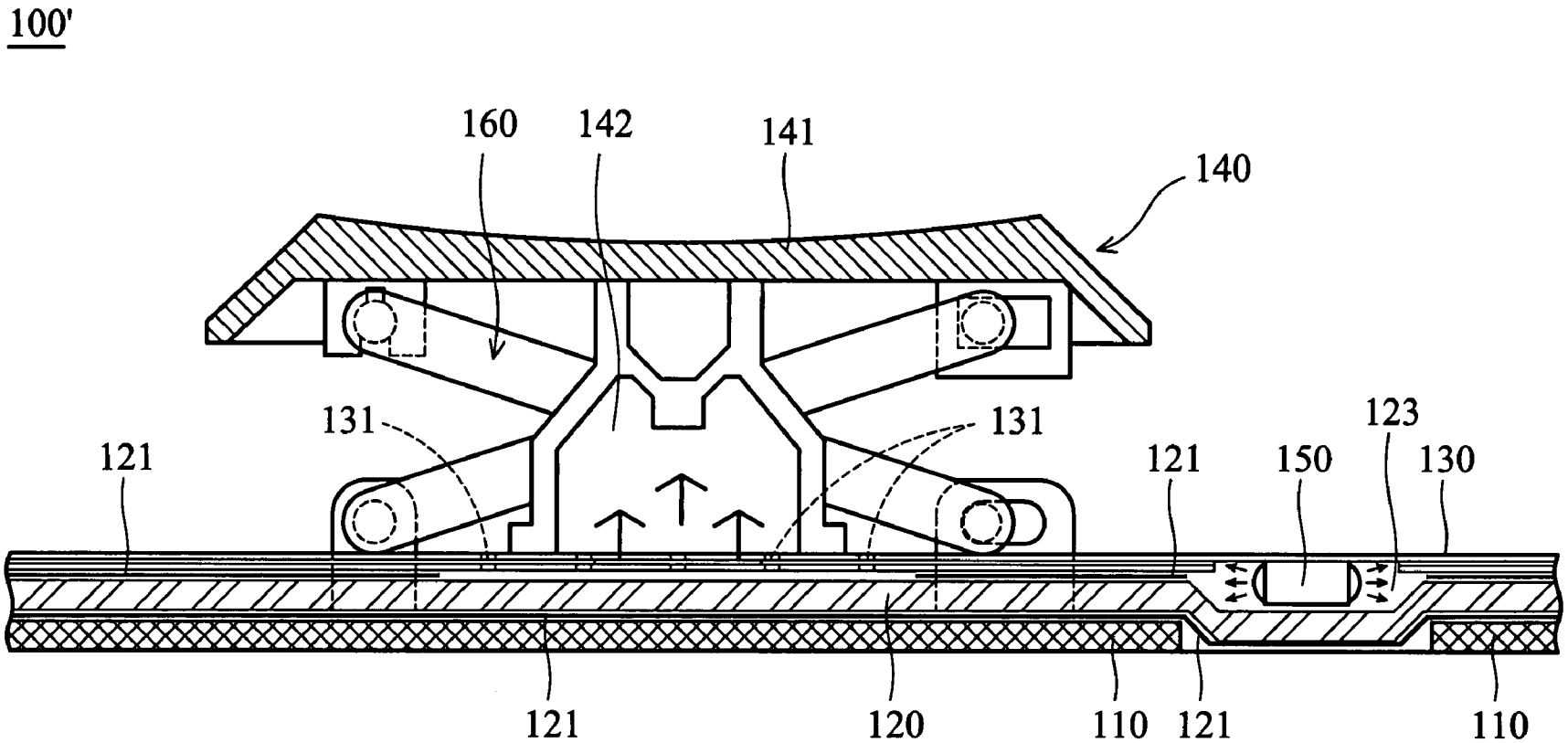
FIG. 3 is a schematic partial cross section of the keyboard structure of the second embodiment of the invention.

Referring to FIG. 3, the keyboard structure 100' also comprises a base plate 110, a light guide member 120, a membrane circuit board 130, a key assembly 140 and a light-emitting element 150. Specifically, the light guide member 120 further comprises a recess 123 to receive the light-emitting element 150.

Similarly, the light from the light-emitting element 150 enters the resilient element 142 and key cap 141 via the light guide member 120 and by reflection of the reflective layers 121. Thus, the key cap 141 can be uniformly illuminated.

Disposition and function of other elements of this embodiment are the same as those of the first embodiment, and explanation thereof will be omitted for simplification of the description.

THIRD EMBODIMENT

Elements corresponding to those in the first embodiment are given the same reference numerals.

Figure 4:
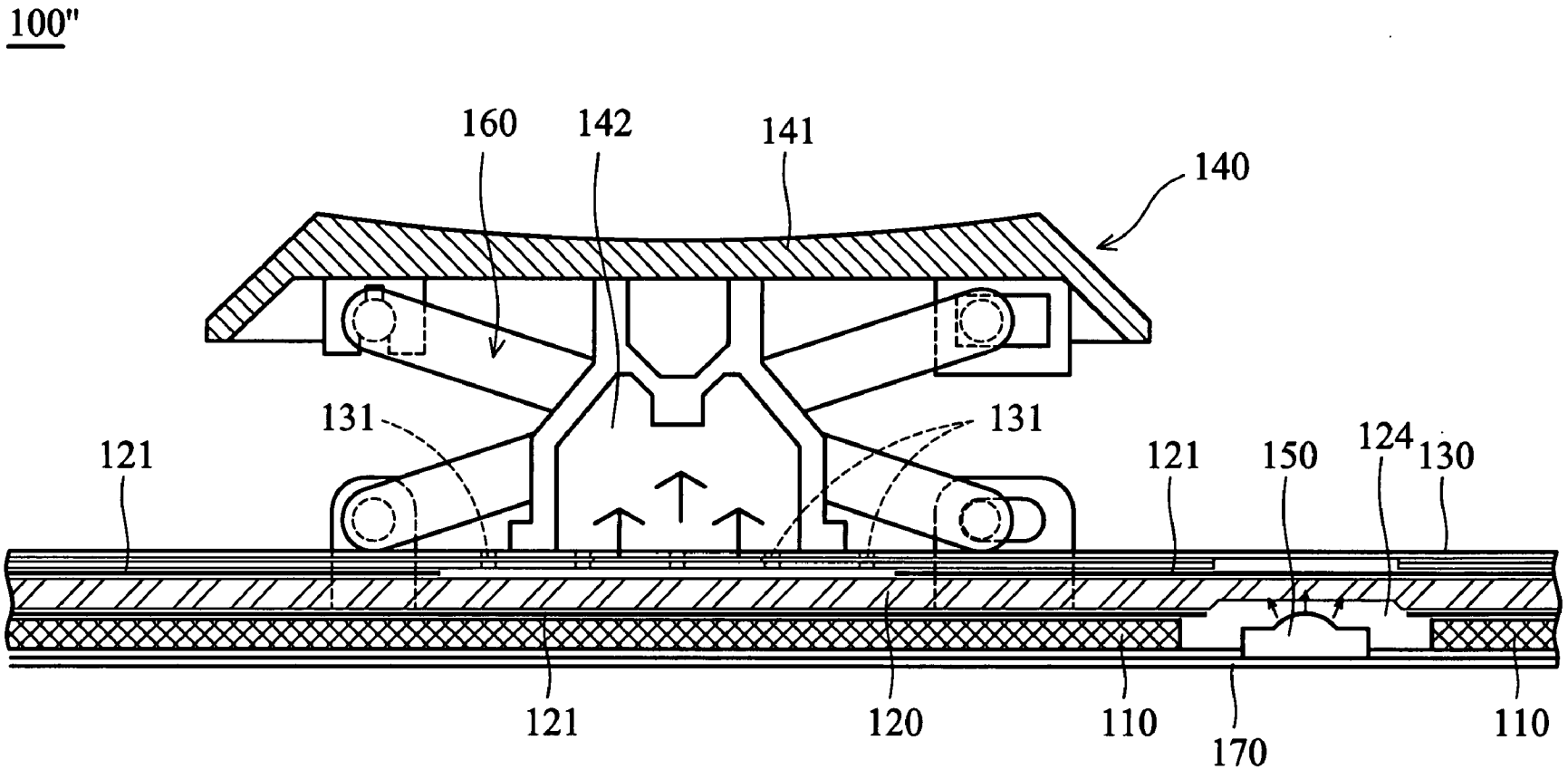
FIG. 4 is a schematic partial cross section of the keyboard structure of the third embodiment of the invention.

Referring to FIG. 4, the keyboard structure 100" also comprises a base plate 110, a light guide member 120, a membrane circuit board 130, a key assembly 140 and a light-emitting element 150. Specifically, the light guide member 120 further comprises a recess 124 to receive the light-emitting element 150. Additionally, a circuit board 170 is disposed under the base plate 110. The light-emitting element 150 is electrically connected to the circuit board 170 to acquire power.

The keyboard structure 100" of this embodiment is similar to the keyboard structure 100' of the second embodiment. The recess 124 of the light guide member 120 of this embodiment faces the base plate 110 while the recess 123 of the light guide member 120 of the second embodiment faces the membrane circuit board 130. In this embodiment, the illumination of the light-emitting element 150 is substantially equal to that in the second embodiment.

Disposition and function of other elements of this embodiment are the same as those of the first or second embodiment, and explanation thereof will be omitted for simplification of the description.

In conclusion, the keyboard structure of the invention has the following advantages. The illumination of the key (key cap) is uniform. The keyboard structure of the invention is simplified and productivity or reliability thereof is enhanced. The keyboard structure of the invention employs fewer light-emitting elements, reducing manufacturing cost thereof. Because the present keyboard structure employs fewer light-emitting elements, fewer electrical connectings to the light-emitting elements are required. Thus, the reliability of the keyboard structure of the invention is enhanced.

While the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A keyboard structure, comprising:

a base plate;

a light guide member disposed on the base plate;

a membrane circuit board disposed on the light guide member;

a key assembly disposed on the membrane circuit board, with a key cap and a resilient element between the key cap and the membrane circuit board;

a circuit board disposed under the base plate; and a light-emitting element adjacent to the light guide member and disposed under the membrane circuit board, wherein the light-emitting element is attached to the circuit board to acquire power, and light from the light-emitting element enters the resilient element and key cap via the light guide member.

2. The keyboard structure as claimed in claim 1, wherein the resilient element is transparent.

3. The keyboard structure as claimed in claim 1, wherein the membrane circuit board is transparent.

4. The keyboard structure as claimed in claim 1, wherein the membrane circuit board further comprises at least one through hole corresponding to the key cap, the light in the light guide member enters the key cap via the through hole.

5. The keyboard structure as claimed in claim 1, wherein the light guide member further comprises at least one reflective layer formed on the surface thereof to reflect the light therein.

6. The keyboard structure as claimed in claim 5, wherein the reflective layer is coated on the surface of the light guide member.

7. The keyboard structure as claimed in claim 5, wherein the reflective layer is attached to the surface of the light guide member.

8. The keyboard structure as claimed in claim 1, wherein the light guide member further comprises a recess to receive the light-emitting element.

9. The keyboard structure as claimed in claim 1, wherein the key assembly further comprises a scissors connection mechanism disposed between the key cap and the membrane circuit board.

10. The keyboard structure as claimed in claim 1, wherein the light-emitting element is a light-emitting diode (LED).

11. The keyboard structure as claimed in claim 1, wherein the keyboard structure is deployed in a computer.

12. The keyboard structure as claimed in claim 1, wherein the keyboard structure is deployed in a cellular phone.

13. The keyboard structure as claimed in claim 1, wherein the keyboard structure is deployed in a PDA.

* * * * *